US010718138B2

(12) United States Patent
Wu

(10) Patent No.: US 10,718,138 B2
(45) Date of Patent: Jul. 21, 2020

(54) ATTACHMENT MEMBER AND LOCK HAVING THE SAME

(71) Applicant: Sinox Co., Ltd., New Taipei (TW)

(72) Inventor: Chia-Ming Wu, New Taipei (TW)

(73) Assignee: Sinox Co., Ltd., New Taipei (TW)

( * ) Notice: Subject to any disclaimer, the term of this patent is extended or adjusted under 35 U.S.C. 154(b) by 0 days.

(21) Appl. No.: 16/007,826

(22) Filed: Jun. 13, 2018

(65) Prior Publication Data

US 2018/0363334 A1 Dec. 20, 2018

(30) Foreign Application Priority Data

Jun. 16, 2017 (TW) ..... 106208742 A

(51) Int. Cl.
*E05B 73/00* (2006.01)
*E05B 37/02* (2006.01)

(52) U.S. Cl.
CPC ..... *E05B 73/0082* (2013.01); *E05B 73/0005* (2013.01); *E05B 37/02* (2013.01)

(58) Field of Classification Search
CPC ..... E05B 37/02; E05B 73/00; E05B 73/0082; E05B 73/0005
USPC ..... 70/14, 18, 19, 30, 49, 58, 57
See application file for complete search history.

(56) References Cited

U.S. PATENT DOCUMENTS 6,058,744 A * 5/2000 Ling ..... E05B 37/025 70/28
6,401,502 B1 * 6/2002 Yang ..... E05B 67/003 70/14
6,449,992 B1 * 9/2002 Yu ..... E05B 73/0082 70/23
6,523,373 B1 * 2/2003 Su ..... E05B 73/0005 70/28
6,601,416 B1 * 8/2003 Sanders ..... E05B 73/0082 70/14
6,619,080 B1 * 9/2003 Yu ..... E05B 73/0005 70/14
6,619,081 B1 * 9/2003 Yu ..... E05B 73/0005 70/14
6,672,117 B2 * 1/2004 Yu ..... E05B 37/0003 70/312
6,918,272 B1 * 7/2005 Sanders ..... E05B 73/0005 70/14
7,234,326 B1 * 6/2007 Lu ..... E05B 73/0005 70/14

(Continued)

*Primary Examiner* — Lloyd A Gall

(74) *Attorney, Agent, or Firm* — Schmeiser, Olsen & Watts LLP

(57) ABSTRACT

A lock contains: an attachment member and a fixing device. The attachment member includes a base, a first movable connection part and a second movable connection part which are rotatably connected on the base can expandable outward and retractable inward. The first movable connection part has a first extension, a first post opposite to the first extension, and a first tab. The second movable connection part has a second extension, a second post opposite to the second extension, and a second tab. The fixing device includes a case and a locking mechanism. The case is configured to fit with the base and has a retaining groove. The locking mechanism is arranged in the case and includes a movable rod configured to separate the first movable connection part from the second movable connection part.

20 Claims, 9 Drawing Sheets

(56) References Cited

U.S. PATENT DOCUMENTS

| | | | | |
|---|---|---|---|---|
| 7,302,816 | B1 * | 12/2007 | Lu | E05B 73/0082 70/14 |
| 7,331,203 | B2 * | 2/2008 | Lee | A47F 7/024 70/14 |
| 7,353,672 | B2 * | 4/2008 | Lu | E05B 73/0005 70/14 |
| 7,401,481 | B1 * | 7/2008 | Lin | E05B 73/0005 70/123 |
| 8,991,225 | B2 * | 3/2015 | Wu | E05B 73/0082 70/14 |
| 9,187,934 | B1 * | 11/2015 | Lee | E05B 73/0005 |
| 2004/0168486 | A1 * | 9/2004 | Ling | E05B 73/0082 70/58 |
| 2008/0034816 | A1 * | 2/2008 | Lu | E05B 73/0082 70/58 |
| 2019/0112840 | A1 * | 4/2019 | Wu | E05B 17/142 |

* cited by examiner

ATTACHMENT MEMBER AND LOCK HAVING THE SAME

FIELD OF THE INVENTION

The present invention relates to a lock having an attachment member which is connected with a locking orifice of a portable device.

BACKGROUND OF THE INVENTION

A portable device (such as a laptop) is in a small size and is expensive, and it is easy to be stolen because of high price and sell with ease.

To overcome such a problem, the portable device has a locking orifice configured to connect with the lock. Normal locking orifice is rectangular and its length and width are 3 mm×7 mm, however there are also 2.5 mm×6 mm, or 3.2 mm×4.5 mm locking orifices to match with various sizes of locks, thus having using limitation.

The present invention has arisen to mitigate and/or obviate the afore-described disadvantages.

SUMMARY OF THE INVENTION

The primary aspect of the present invention is to provide a lock having an attachment member which is connected with a locking orifice of a portable device.

To obtain above-mentioned aspect, a lock provided by the present invention contains an attachment member and a fixing device.

The attachment member is configured to connect with a locking orifice of a portable device, and the attachment member includes a base, a first movable connection part and a second movable connection part which are rotatably connected on the base can expandable outward and retractable inward, wherein the first movable connection part has a first extension coupled with the locking orifice, a first post opposite to the first extension, and a first tab formed on an outer wall of the first post, wherein the second movable connection part has a second extension coupled with the locking orifice, a second post opposite to the second extension, and a second tab formed on an outer wall of the second post.

The fixing device includes a case and a locking mechanism.

The case is configured to fit with the base and has a retaining groove formed in the case.

The locking mechanism is arranged in the case and includes a movable rod configured to separate the first movable connection part from the second movable connection part so that the first protrusion of the first post and the second protrusion of the second post retain in a first position of the retaining groove, the first movable connection part and the second movable connection part expand outward or retract inward, and the first protrusion of the first post and the second protrusion of the second post remove from a second position of the retaining groove.

Preferably, the base is a circular column.

Preferably, the first post of the first movable connection part has a first recess formed on an inner wall thereof, and the second post of the second movable connection part has a second recess formed on an inner wall thereof.

Preferably, the first post further has a first tilted guide face arranged on an edge thereof, and the second post further has a second tilted guide face arranged on an edge thereof.

Preferably, the locking mechanism is a key locking mechanism.

Preferably, the locking mechanism is a combination locking mechanism.

Preferably, the case is in connection with a flexible chain.

DETAILED DESCRIPTION OF THE PREFERRED EMBODIMENTS

Figure 1:
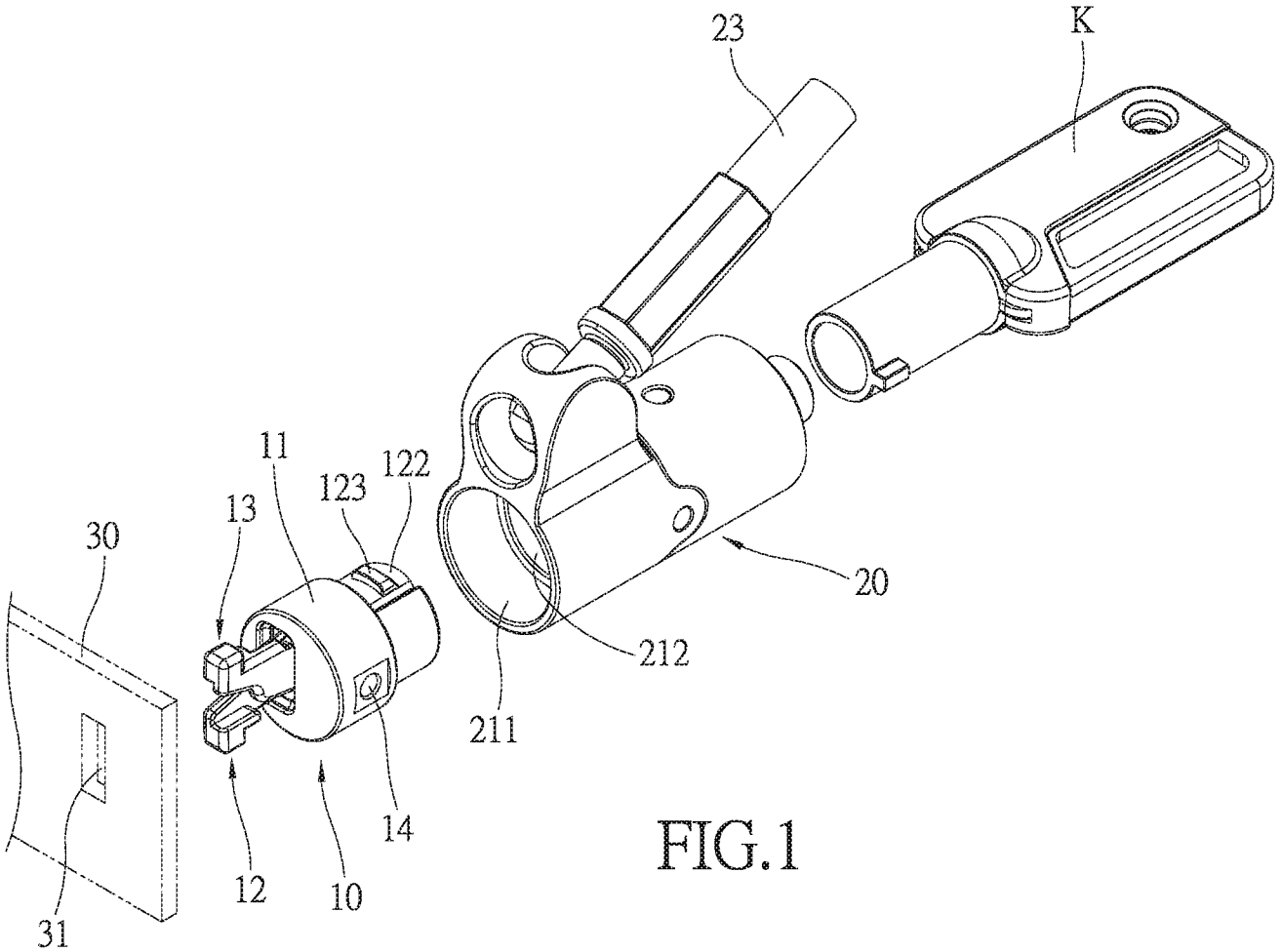
FIG. 1 is a perspective view showing the exploded components of a lock according to a first embodiment of the present invention.
Figure 2:
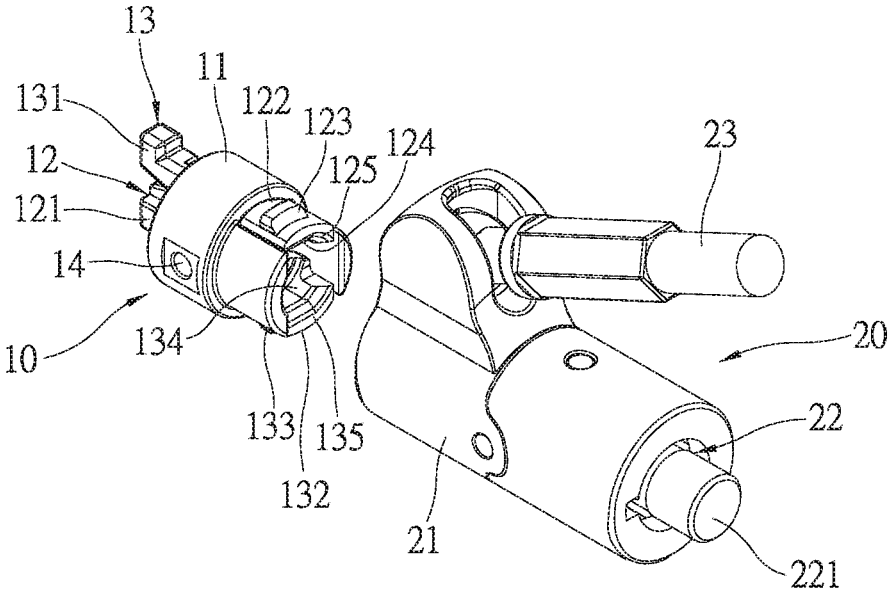
FIG. 2 is another perspective view showing the exploded components of the lock according to the first embodiment of the present invention.
Figure 3:
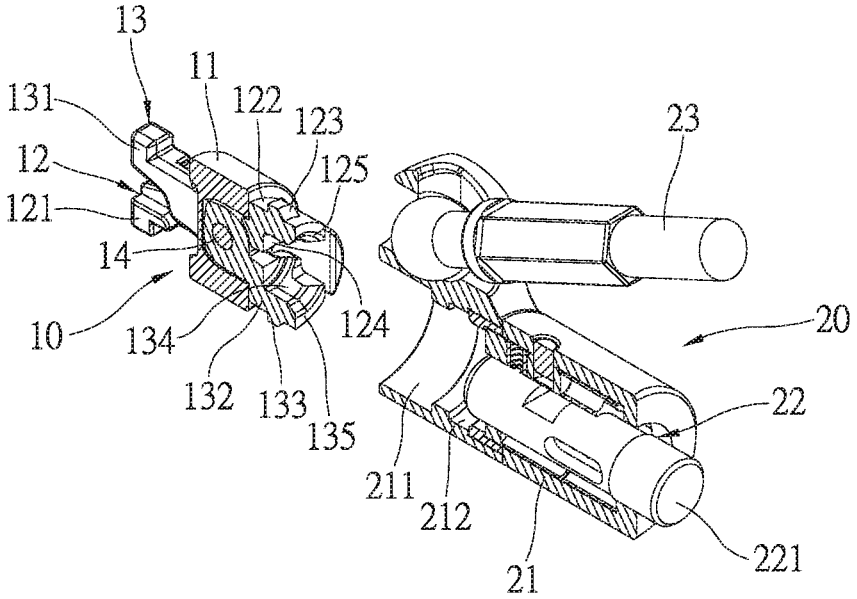
FIG. 3 is a cross-sectional perspective view showing the exploded components of the lock according to the first embodiment of the present invention.

With reference to FIGS. 1-3, a lock according to a first embodiment of the present invention comprises an attachment member 10 configured to connect with a locking orifice 31 or a locking cavity of a portable device 30, and a fixing device 20 connecting with the attachment member 10.

The attachment member 10 includes a base 11, a first movable connection part 12 and a second movable connection part 13 which are rotatably connected on the base 11 by using a coupling shaft 14 allow the first movable connection part 12 and the second movable connection part 13 to expandable outward and retractable inward, wherein the first movable connection part 12 has a first extension 121 coupled with the locking orifice, a first post 122 opposite to the first extension 121, and a first tab 123 formed on an outer wall of the first post 122, wherein the second movable connection part 13 has a second extension 131 coupled with the locking orifice, a second post 132 opposite to the second extension 131, and a second tab 133 formed on an outer wall of the second post 132.

The fixing device includes a case 21 and a locking mechanism 22 arranged in the case 21. The case 21 has a circular opening 211 defined on an end thereof so as to fit with the base 11, and the case 21 has a retaining groove 212 formed therein. The case 21 is in connection with a flexible chain 23 or a cable. The locking mechanism 22 includes a movable rod 221 configured to separate the first movable connection part 12 from the second movable connection part 13 so that the first protrusion 123 of the first post 122 and the second protrusion 133 of the second post 132 retain in a first position of the retaining groove 212, the first movable connection part 12 and the second movable connection part 13 expand outward or retract inward, and the first protrusion 123 of the first post 122 and the second protrusion 133 of the second post 132 remove from a second position of the retaining groove 212. The first post 122 of the first movable connection part 12 has a first recess 124 formed on an inner wall thereof, and the second post 132 of the second movable connection part 13 has a second recess 134 formed on an inner wall thereof. The first post 122 further has a first tilted guide face 125 arranged on an edge thereof, and the second post 132 further has a second tilted guide face 135 arranged on an edge thereof.

The base 11 is a circular column so as to match with the circular opening 211 of the case 2 and to movably fit the fixing device 20 on the base 11.

Figure 9:
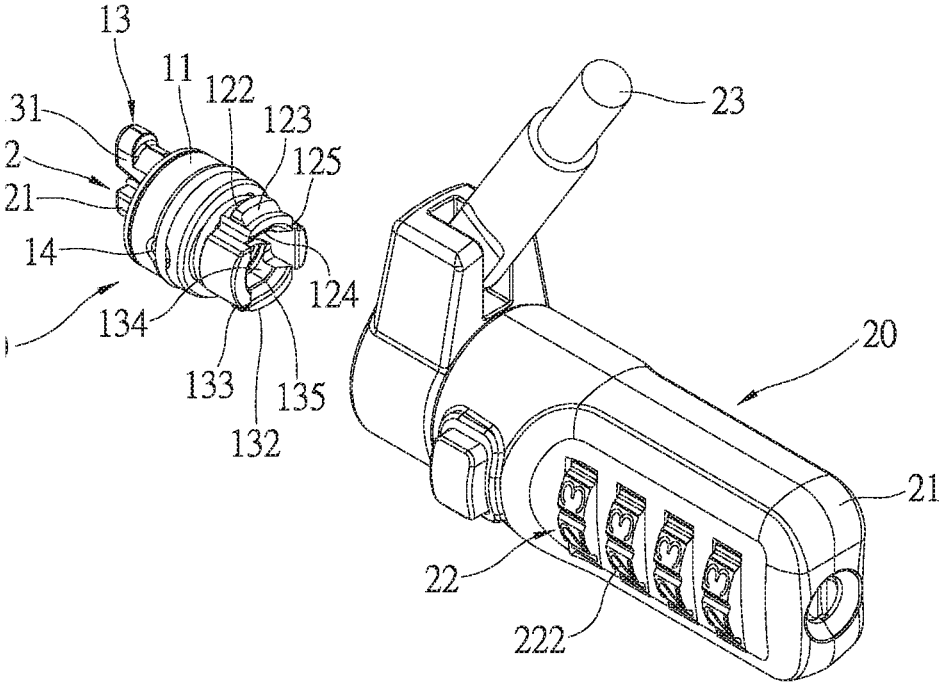
FIG. 9 is a perspective view showing the application of a lock according to a fourth embodiment of the present invention.
Figure 10:
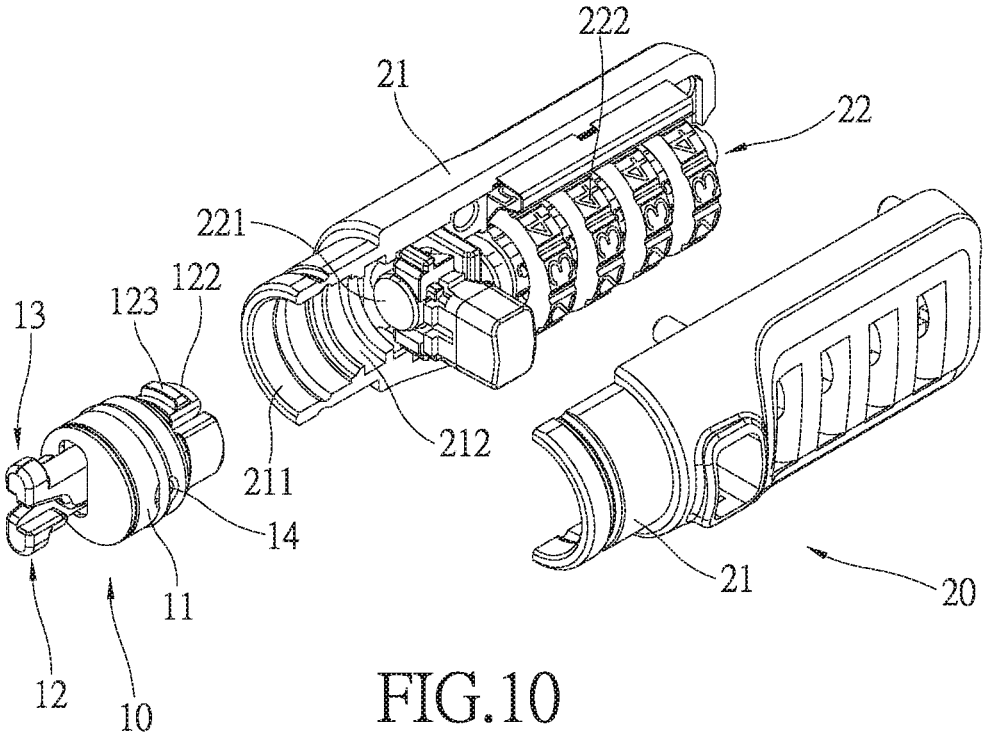
FIG. 10 is a perspective view showing the exploded components of the lock according to the fourth embodiment of the present invention.

The locking mechanism 22 is a key locking mechanism which is locked or unlocked by using a key K. In another embodiment, the locking mechanism 22 is a combination locking mechanism, as shown in FIGS. 9 and 10. In another embodiment, the locking mechanism 22 is a combination of the key locking mechanism and the combination locking mechanism.

Figure 4:
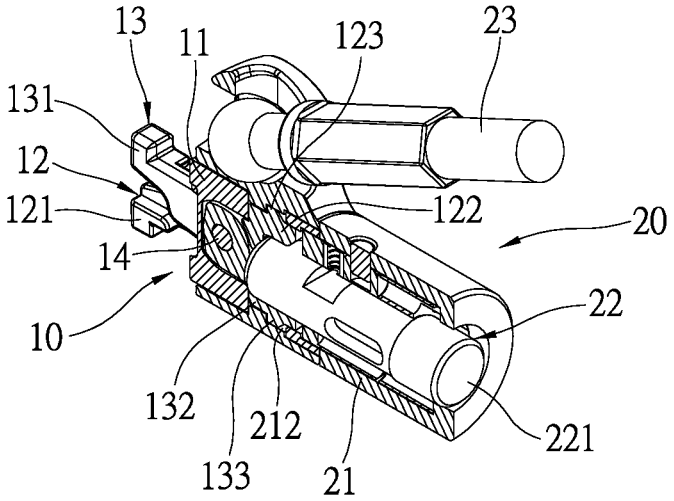
FIG. 4 is a cross-sectional perspective view showing the assembly of the lock according to the first embodiment of the present invention.
Figure 5:
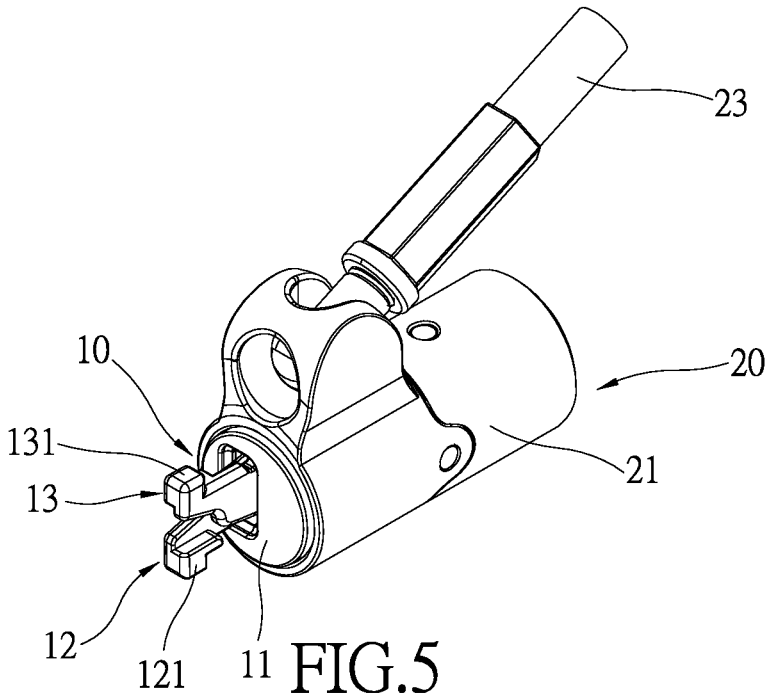
FIG. 5 is a perspective view showing the assembly of the lock according to the first embodiment of the present invention.

Referring to FIGS. 4 and 5, the lock of the present invention comprises the attachment member 10 and the fixing device 20 connecting with the attachment member 10 so that the first movable connection part 12 and the second movable connection part 13 are locked.

Figure 6A:
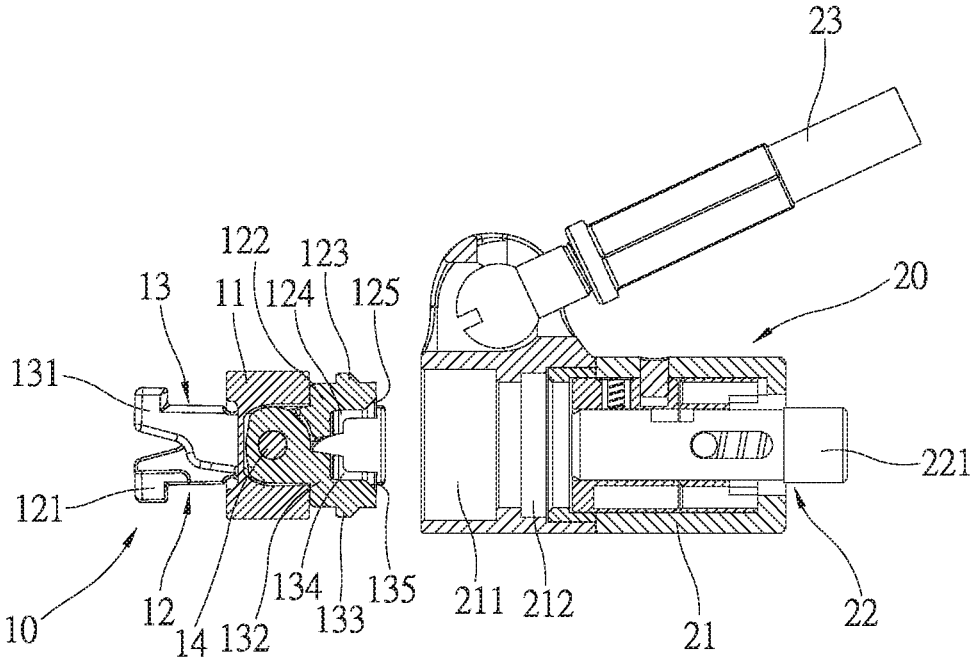
FIGS. 6A-6E are a cross sectional view showing the operation of the lock according to the first embodiment of the present invention.
Figure 6B:
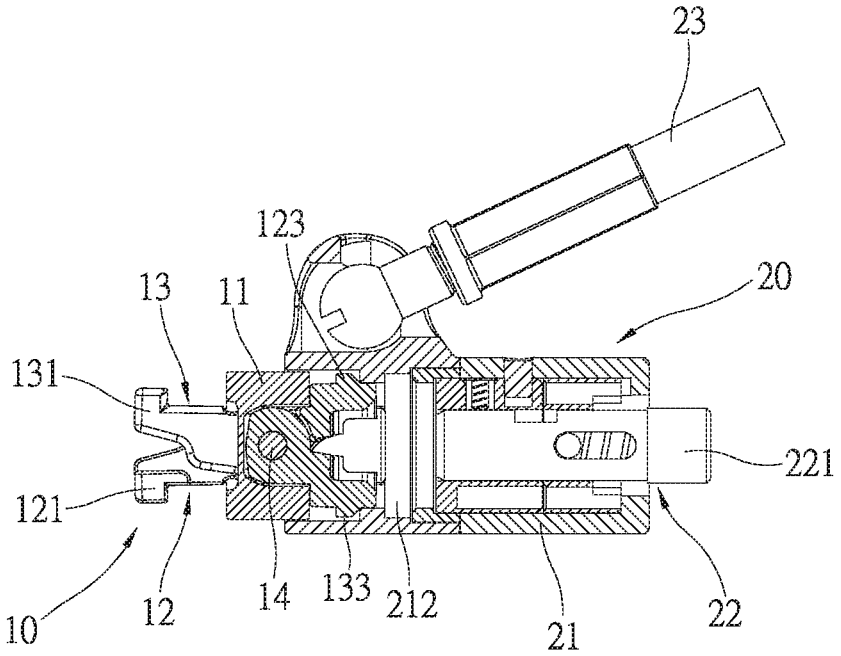
Figure 6C:
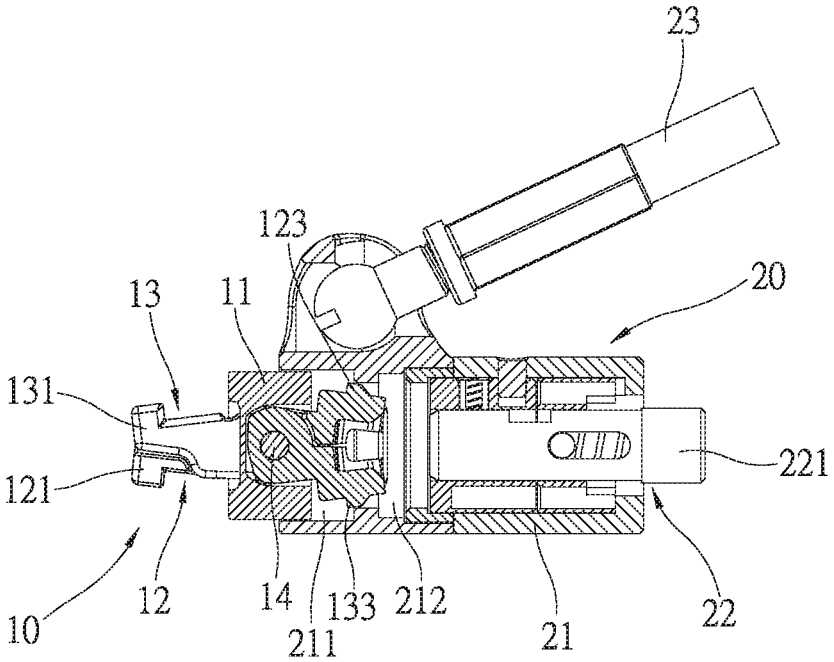
Figure 6D:
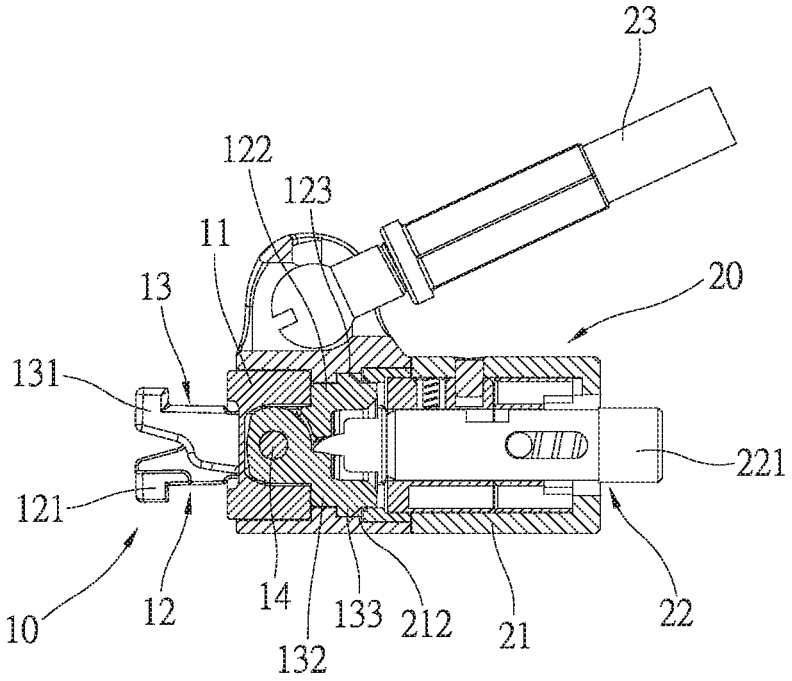
Figure 6E:
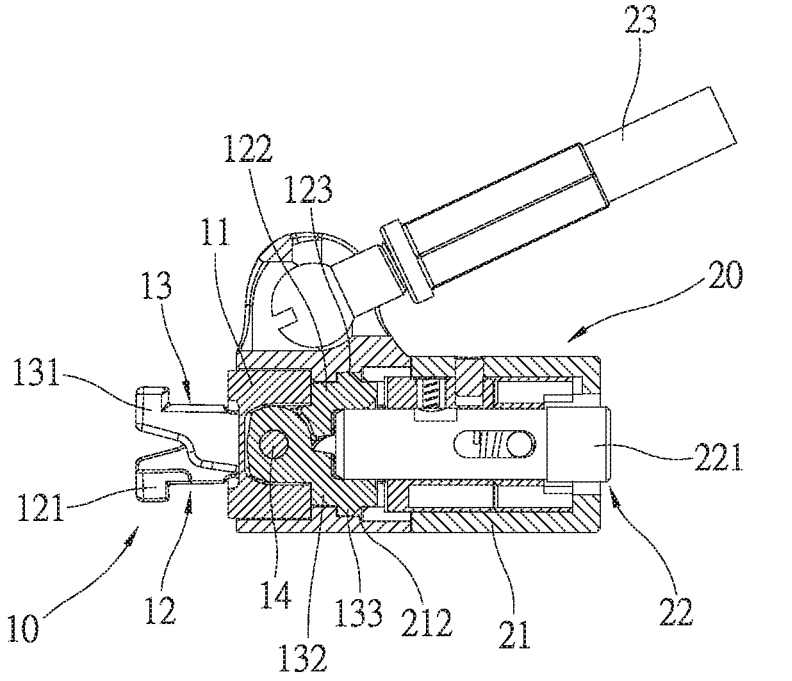

FIGS. 6A-6E are a cross-sectional view showing the operation of the lock according to the preferred embodiment of the present invention. As shown in FIG. 6A, the first extension 121 of the first movable connection part 12 and the second extension 131 of the second movable connection part 13 are coupled with the locking orifice of the portable device. As illustrated in FIGS. 6B-6C, the case 21 of the fixing device 20 is fitted with an end of the attachment member 10 so that the first post 122 of the first movable connection part 12 and the second post 132 of the second movable connection part 13 move into the circular opening 211 until the first protrusion 123 of the first post 122 and the second protrusion 133 of the second post 132 retain in the retaining groove 212. As shown in FIG. 6D, after the movable rod 221 of the fixing mechanism 22 moves to the second position of the retaining groove 212 from the first position of the retaining groove 212, the movable rod 221 is fixed in the first recess 124 and the second recess 134 via the first tilted guide face 125 and the second tilted guide face 135 so that the first movable connection part 12 and the second movable connection part 13 of the attachment member 10 are locked.

In contrast, the movable rod 221 is moved back to the first position so that the first movable connection part 12 and the second movable connection part 13 retract inward, and the first protrusion 123 of the first post 122 and the second protrusion 133 of the second post 132 remove from the retaining groove 212, thus detaching the fixing device 20 from the attachment member 10.

Figure 7A:
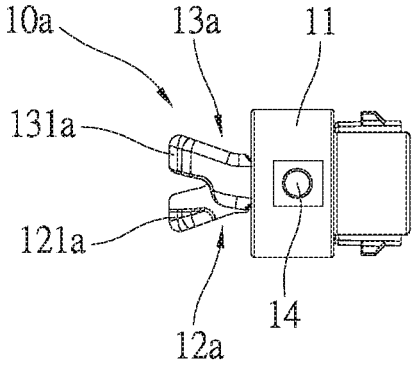
FIG. 7A is a side plan view showing the assembly of an attachment member according to a second embodiment of the present invention.
Figure 7B:
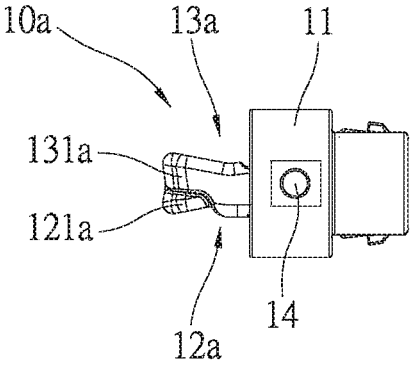
FIG. 7B is a side plan view showing the operation of the attachment member according to the second embodiment of the present invention.
Figure 8A:
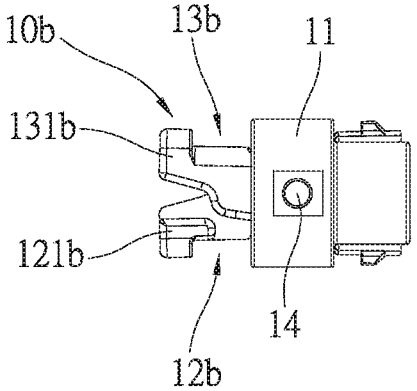
FIG. 8A is a side plan view showing the assembly of an attachment member according to a third embodiment of the present invention.
Figure 8B:
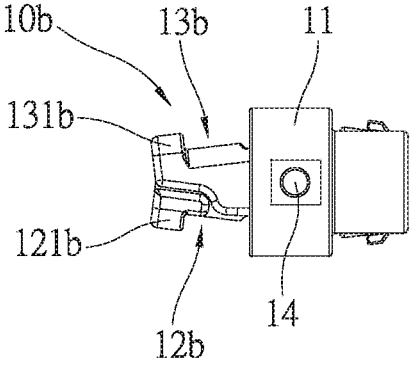
FIG. 8B is a side plan view showing the operation of the attachment member according to the third embodiment of the present invention.

FIGS. 7A and 7B are a side plan view showing the assembly of an attachment member according to a second embodiment of the present invention. FIGS. 8A and 8B are a side plan view showing the assembly of an attachment member according to a third embodiment of the present invention. For example, the attachment member 10 matches with the portable devices having locking orifices of various sizes and shapes respectively. Preferably, the attachment member 10 is detachable from the fixing device 20, so attachment members 10*a*, 10*b* match with first and second extensions 121*a*, 131*a*, 121*b*, 131*b* of first and second movable connection parts 12*a*, 12*b*, 13*a*, 13*b* of various sizes and shapes.

Referring to FIGS. 9 and 10, in a fourth embodiment, a lock having an attachment member is a combination locking mechanism, wherein the lock comprises an attachment member 10 configured to connect with a locking orifice or a locking cavity of a portable device, and a fixing device 20 connecting with the attachment member 10.

The attachment member 10 includes a base 11, a first movable connection part 12 and a second movable connection part 13 which are rotatably connected in the base 11 by using a coupling shaft 14 so as to be expandable and retractable with each other, wherein the first movable connection part 12 has a first extension 121 coupled with the locking orifice, a first post 122 opposite to the first extension 121, and a first tab 123 formed on an outer wall of the first post 122, wherein the second movable connection part 13 has a second extension 131 coupled with the locking orifice, a second post 132 opposite to the second extension 131, and a second tab 133 formed on an outer wall of the second post 132.

Figure 11A:
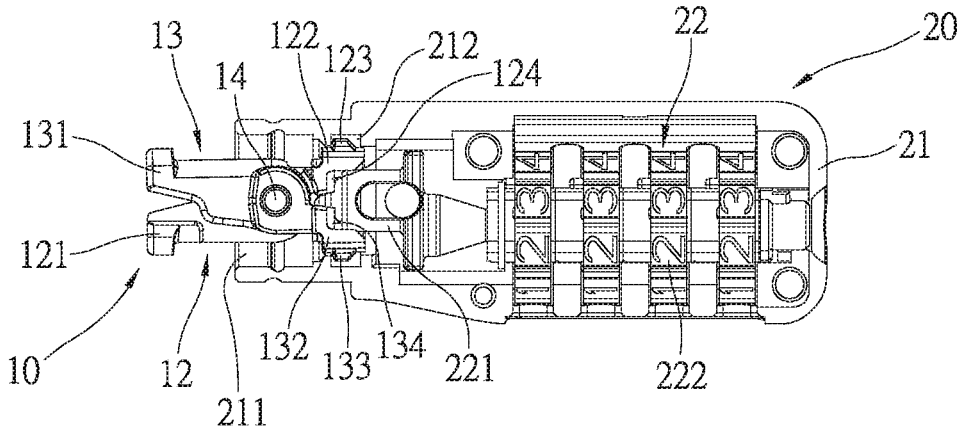
FIG. 11A is a side plan view showing the operation of the lock according to the fourth embodiment of the present invention.
Figure 11B:
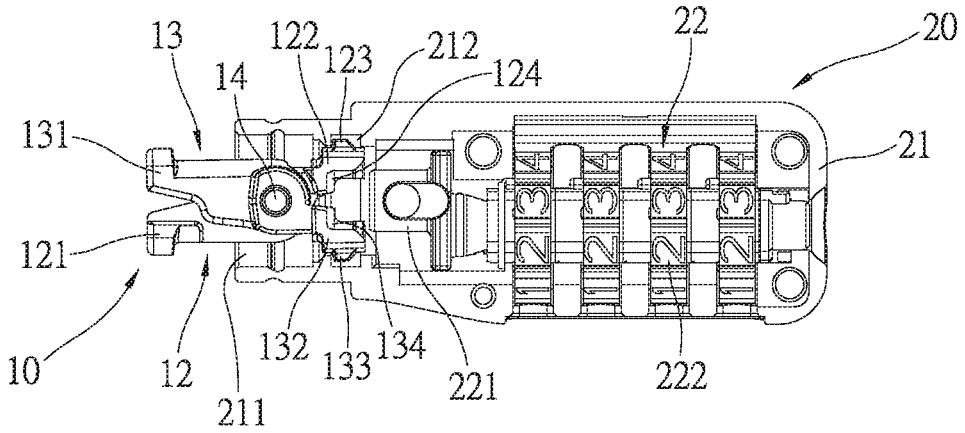
FIG. 11B is another side plan view showing the operation of the lock according to the fourth embodiment of the present invention.

The locking mechanism 22 of the fixing device 20 is a combination locking mechanism so as to lock or unlock the attachment member by way of a rotating disc 222. The locking mechanism 22 includes a movable rod 221 configured to separate the first movable connection part 12 from the second movable connection part 13 when the attachment member 10 is fitted with the fixing device 20, and the first protrusion 123 of the first post 122 and the second protrusion 133 of the second post 132 retain in a first position of the retaining groove 212 (as shown in FIG. 11A). On the contrary, the movable rod 221 is moved so that the first movable connection part 12 and the second movable connection part 13 retract inward, and the first protrusion 123 of the first post 122 and the second protrusion 133 of the second post 132 remove from the second position of the retaining groove 212 (as illustrated in FIG. 11B).

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A lock configured to be coupled to a locking orifice of a portable device, the lock comprising:

an attachment member configured to be coupled to the locking orifice of the portable device, the attachment member including a base, and a first movable connection part and a second movable connection part which are coupled to the base, wherein the first movable connection part has a first extension configured to be coupled to the locking orifice, a first post opposite to the first extension, and a first tab formed on an outer wall of the first post and disposed outside the base, wherein the second movable connection part has a second extension configured to be coupled to the locking orifice, a second post opposite to the second extension, and a second tab formed on an outer wall of the second post and disposed outside the base; and a fixing device including:

a case configured to be coupled to the base and having a retaining groove formed in the case; and a locking mechanism arranged in the case and including a movable rod configured to move between the first post of the first movable connection part and the second post of the second movable connection part when the first post and the second post move away from each other so that the first tab of the first post and the second tab of the second post are retained in the retaining groove, the first post of the first movable connection part and the second post of the second movable connection part being movable toward each other so that the first tab of the first post and the second tab of the second post are removed from the retaining groove.

2. The lock as claimed in claim 1, wherein the base is a circular column.

3. The lock as claimed in claim 1, wherein the first post of the first movable connection part has a first recess formed on an inner wall thereof, and the second post of the second movable connection part has a second recess formed on an inner wall thereof.

4. The lock as claimed in claim 3, wherein the first post further has a first tilted guide face arranged on an edge thereof, and the second post further has a second tilted guide face arranged on an edge thereof.

5. The lock as claimed in claim 1, wherein the locking mechanism is a key locking mechanism.

6. The lock as claimed in claim 1, wherein the locking mechanism is a combination locking mechanism.

7. The lock as claimed in claim 1, wherein the case is in connection with a flexible chain.

8. The lock as claimed in claim 1, wherein the first extension and the second extension move away from each other when the first post and the second post move away from each other and the first extension and the second extension move toward each other when the first post and the second post move toward each other.

9. The lock as claimed in claim 3, wherein the movable rod is configured to move in the first recess and the second recess when the first post and the second post move away from each other.

10. The lock of claim 4, wherein the movable rod is further configured to move between the first post and the second post along the first tilted guide face and the second tilted guide face.

11. The lock as claimed in claim 1, wherein the case is further formed with a protrusion on an inner wall thereof configured to abut the first post and the second post during coupling of the case to the base to move the first post and the second post toward each other.

12. The lock as claimed in claim 1, wherein the case is further formed with a protrusion on an inner wall thereof configured to be disposed between the base and the first tab when the case is coupled to the base.

13. The lock as claimed in claim 1, wherein the case surrounds the base when the case is coupled to the base.

14. An attachment member configured to be coupled to a locking orifice of a portable device, the attachment member comprising:

a base; and a first movable connection part and a second movable connection part which are coupled to the base, wherein the first movable connection part has a first extension configured to be coupled to the locking orifice, a first post opposite to the first extension, and a first tab formed on an outer wall of the first post and disposed outside the base, wherein the second movable connection part has a second extension configured to be coupled to the locking orifice, a second post opposite to the second extension, and a second tab formed on an outer wall of the second post and disposed outside the base.

15. The attachment member as claimed in claim 14, wherein the base is a circular column.

16. The attachment member as claimed in claim 14, wherein the first post further has a first tilted guide face arranged on an edge thereof, and the second post further has a second tilted guide face arranged on an edge thereof.

17. The attachment member as claimed in claim 14, wherein each of the first and second tabs has a first sidewall facing the base and an inclined second sidewall opposite the first sidewall.

18. The attachment member as claimed in claim 14, wherein the first extension and the second extension move away from each other when the first post and the second post move away from each other and the first extension and the second extension move toward each other when the first post and the second post move toward each other.

19. The attachment member of claim 14, wherein the first and second posts abut a sidewall of the base when the first and second posts move away from each other.

20. The attachment member of claim 14, wherein the first and second posts move away from a sidewall of the base when the first and second posts move toward each other.

* * * * *